US011503695B2

(12) United States Patent
Qu et al.

(10) Patent No.: US 11,503,695 B2
(45) Date of Patent: Nov. 15, 2022

(54) LIGHT FIXTURE CONTROL SYSTEM AND ILLUMINATION SYSTEM

(71) Applicant: SHENZHEN STEP ELECTRONIC AND LIGHTING CO., LTD, Guangdong (CN)

(72) Inventors: Xinyuan Qu, Guangdong (CN); Yongjun Wei, Guangdong (CN)

(73) Assignee: SHENZHEN STEP ELECTRONIC AND LIGHTING CO., LTD, Shenzhen (CN)

( * ) Notice: Subject to any disclaimer, the term of this patent is extended or adjusted under 35 U.S.C. 154(b) by 0 days.

(21) Appl. No.: 17/387,993

(22) Filed: Jul. 28, 2021

(65) Prior Publication Data

US 2021/0360766 A1 Nov. 18, 2021

Related U.S. Application Data

(63) Continuation of application No. PCT/CN2019/128376, filed on Dec. 25, 2019.

(30) Foreign Application Priority Data

Dec. 25, 2018 (CN) ..... 201811588574.X

(51) Int. Cl.
*H05B 47/19* (2020.01)
*H05B 45/325* (2020.01)
(Continued)

(52) U.S. Cl.
CPC ..... *H05B 47/19* (2020.01); *F21V 23/0435* (2013.01); *H05B 45/325* (2020.01); *F21Y 2115/10* (2016.08)

(58) Field of Classification Search
CPC ..... H05B 47/19; H05B 45/325; H05B 45/20; H05B 33/08; H05B 47/10; H05B 47/175;
(Continued)

(56) References Cited

U.S. PATENT DOCUMENTS 8,686,646 B2 * 4/2014 Tanaka ..... H05B 45/10 315/152
2002/0047628 A1 4/2002 Morgan et al.
(Continued)

FOREIGN PATENT DOCUMENTS

CN 102440076 A 5/2012
CN 102970796 A 3/2013
(Continued)

OTHER PUBLICATIONS

International Search Report of PCT Patent Application No. PCT/CN2019/128376 dated Mar. 25, 2020.
(Continued)

*Primary Examiner* — Bao Q Truong

(57) ABSTRACT

Disclosed are a light fixture control system and an illumination system. The light fixture control system includes a control box (100) and at least one wireless switch (200), and the wireless switch (200) is wirelessly and communicatively connected to the control box (100); an output end of the control box (100) is connected to an LED lamp, the control box (100) includes a main controller (110), a code matching control circuit (140), a first wireless communication circuit (130) and a multiple-independent-output control interface circuit (150), the main controller (110) is connected to the code matching control circuit (150) and the first wireless communication circuit (130), respectively and an output end of the main controller (110) is connected to the multiple-independent-output control interface circuit (150); output ends of the multiple-independent-output control interface circuit (150) are connected to a plurality of LED lamps in a one-to-one correspondence.

18 Claims, 4 Drawing Sheets

(51) Int. Cl.
*F21V 23/04* (2006.01)
*F21Y 115/10* (2016.01)

(58) Field of Classification Search
CPC ..... H05B 45/00; H05B 45/30; H05B 45/10; F21V 23/0435; F21Y 2115/10
See application file for complete search history.

(56) References Cited

U.S. PATENT DOCUMENTS

| | | | | |
|---|---|---|---|---|
| 2011/0234555 | A1* | 9/2011 | Kwag | H05B 47/19 345/204 |
| 2012/0074850 | A1* | 3/2012 | Tanaka | H05B 47/155 315/152 |

FOREIGN PATENT DOCUMENTS

| | | | |
|---|---|---|---|
| CN | 204345503 | U | 5/2015 |
| CN | 106937433 | A | 7/2017 |
| CN | 207340236 | U | 5/2018 |
| CN | 109413809 | A | 3/2019 |
| CN | 209593842 | U | 11/2019 |
| EP | 3182233 | A1 | 6/2017 |

OTHER PUBLICATIONS

Extended search report of counterpart European Patent Application No. 19903129.5 dated Aug. 26, 2022.

* cited by examiner

LIGHT FIXTURE CONTROL SYSTEM AND ILLUMINATION SYSTEM

CROSS-REFERENCE TO RELATED APPLICATION

The present application is a continuation of international application of PCT application No. PCT/CN2019/128376 filed on Dec. 25, 2019, which claims the priority benefit of China application No. 201811588574. X filed on Dec. 25, 2018. The entirety of the above-mentioned patent applications is incorporated herein by reference and made a part of this specification.

BACKGROUND

Technical Field

This application relates to the technical field of light fixture illumination, and in particular to a light fixture control system and an illumination system.

Description of Related Art

Currently, a household LED illumination switch is usually physically connected via an electric wire, and the switch connecting wire adopted in such a manner is long, and therefore, problems of low installation efficiency and high installation cost exist. Moreover, a single LED control box does not have multiple independent output control interfaces at present, so that a switch set to be connected to the LED control box not only can be controlled independently, but also be controlled in combination with the LED lamp.

SUMMARY

In various aspects, embodiments of this application provide a light fixture control system and an illumination system, and aim to solve the problems that a single control box in a current light fixture control system does not have multiple independent output control interfaces, can only perform the control of LED lamps uniformly at the same time, cannot implement the combined control of LED lamps, cannot adapt to different lighting scenarios, resulting in poor applicability, high cost and high energy consumption.

Accordingly, embodiments of this application provide a light fixture control system, the light fixture control system includes a control box and at least one wireless switch, and the wireless switch is wirelessly and communicatively connected to the control box; an output end of the control box is connected to an LED lamp, the control box includes a main controller, a code matching control circuit, a first wireless communication circuit and a multiple-independent-output control interface circuit, the main controller is connected to the code matching control circuit and the first wireless communication circuit, respectively and an output end of the main controller is connected to the multiple-independent-output control interface circuit; output ends of the multiple-independent-output control interface circuit are connected to a plurality of LED lamps in a one-to-one correspondence; where, the first wireless communication circuit is configured to receive a wireless switch signal output by the wireless switch;

the code matching control circuit is configured to output a corresponding code matching signal to the main controller according to an operation instruction of a user; and the main controller is configured to output a corresponding LED switch control signal to the multiple-independent-output control interface circuit according to the code matching signal and the wireless switch signal, and is configured to drive a corresponding LED lamp to operate.

In some embodiments, the light fixture control system further includes a power supply, an output end of the power supply is connected to a power supply input end of the control box, and the power supply is configured to supply power to the control box and a plurality of LED lamps.

In some embodiments, the first wireless communication circuit includes one or more of a 2.4G module, a Bluetooth module, an infrared module, a WIFI module, and a ZigBee module.

In some embodiments, the wireless switch includes one or more of a wireless gesture switch, a wireless PIR switch, a wireless touch switch, a wireless microwave switch, a wireless mechanical key switch.

In some embodiments, the wireless switch includes a battery assembly, a sensing port circuit, a signal processor and a second wireless communication circuit, and an output end of the battery assembly is connected to the sensing port circuit, the signal processor and the second wireless communication circuit, respectively; an input end of the sensing port circuit is configured to input a sensing signal, and an output end of the sensing port circuit is connected to the signal processor; an output end of the signal processor is connected to the second wireless communication circuit; an output end of the second wireless communication circuit is an output end of the wireless switch, where, the sensing port circuit is triggered based on an operation instruction of a user and outputs a corresponding trigger signal to the signal processor;

the signal processor is configured to generate a first control signal according to the received trigger signal and output the first control signal; and the second wireless communication circuit is configured to output the received first control signal to the first wireless communication circuit.

In some embodiments, the sensing port circuit includes one or more of a touch assembly, a mechanical key assembly, an infrared emission detection assembly, a human body heat sensing detection assembly, and a microwave detection assembly.

In some embodiments, the second wireless communication circuit includes one or more of a 2.4G module, a Bluetooth module, an infrared module, a WIFI module, and a ZigBee module.

In some embodiments, the main controller includes a PWM dimming circuit, an output end of the main controller is connected to an input end of the PWM dimming circuit, and an output end of the PWM dimming circuit is configured to be connected to an LED lamp.

In some embodiments, the PWM dimming circuit includes a first resistor, a second resistor, a third resistor, a fourth resistor, a fifth resistor, a sixth resistor, a seventh resistor, a first electronic switch, a second electronic switch, and a third electronic switch, a first end of the first resistor is configured to input a PWM dimming signal, a second end of the first resistor, a controlled end of the first electronic switch, and a first end of the second resistor are interconnected; a first connecting end of the first electronic switch, a first end of the fourth resistor, and a first end of the third resistor are interconnected, a second connecting end of the first electronic switch, a second end of the second resistor, a second end of the fifth resistor, a second end of the sixth resistor, and a second connecting end of the third electronic switch are grounded; a second end of the third resistor, a first end of the fifth resistor, and a controlled end of the second electronic switch are interconnected; a first connecting end of the second electronic switch, a second end of the seventh resistor, a first end of the sixth resistor, and a controlled end of the third electronic switch are interconnected; a second end of the fourth resistor, a first end of the seventh resistor, and a first end of the LED lamp are interconnected; a second end of the LED lamp is connected to a second connecting end of the third electronic switch, and a first end of the LED lamp is connected to a first direct current power supply.

Embodiments of this application further provide an illumination system, which includes the light fixture control system described above, the light fixture control system includes a control box and at least one wireless switch, and the wireless switch is wirelessly and communicatively connected to the control box; an output end of the control box is connected to an LED lamp, the control box includes a main controller, a code matching control circuit, a first wireless communication circuit and a multiple-independent-output control interface circuit, the main controller is connected to the code matching control circuit and the first wireless communication circuit, respectively and an output end of the main controller is connected to the multiple-independent-output control interface circuit; output ends of the multiple-independent-output control interface circuit are connected to a plurality of LED lamps in a one-to-one correspondence; where, the first wireless communication circuit is configured to receive a wireless switch signal output by the wireless switch; the code matching control circuit is configured to output a corresponding code matching signal to the main controller according to an operation instruction of a user; and the main controller is configured to output a corresponding LED switch control signal to the multiple-independent-output control interface circuit according to the code matching signal and the wireless switch signal, and is configured to drive a corresponding LED lamp to operate.

By arranging the code matching control circuit in the present application, the control box outputs a corresponding code matching signal to the main controller, after receiving a code matching instruction of the wireless switch. In this way, the main controller outputs a plurality of code matching control instructions when receiving corresponding code matching signals. Therefore, code matching of multiple output channels of the multiple-independent-output control interface circuit by each wireless switch is realized, in turn, a single or combined control of the LED lamps is realized by the control box. The present application implements the function of independently controlling LED lamp groups or controlling LED lamp groups in a combined way, and solves the problem that a single control box in a current light fixture control system does not have multiple independent output control interfaces, can only perform the control of LED lamps uniformly at the same time, cannot implement the combined control of LED lamps, cannot adapt to different lighting scenarios, resulting in poor applicability, high cost and high energy consumption.

BENEFICIAL EFFECT

The present application implements the function of independently controlling LED lamp groups or controlling LED lamp groups in a combined way, and solves the problem that a single control box in a current light fixture control system does not have multiple independent output control interfaces, can only perform the control of LED lamps uniformly at the same time, cannot implement the combined control of LED lamps, cannot adapt to different lighting scenarios, resulting in poor applicability, high cost and high energy consumption.

DESCRIPTION OF THE EMBODIMENTS

The technical solutions in the embodiments of the present application are hereinafter described clearly and completely with reference to the accompanying drawings. Obviously, the embodiments described here are only part of the embodiments of the present application rather than all the embodiments. All other embodiments obtained by persons skilled in the art based on the embodiments of the present application without creative efforts shall fall within the protection scope of the present application.

It should be noted that, if the embodiments of the present application involve in directional indications such as upper, lower, left, right, front, rear, and the like, then the directional indication is set only to explain relative positional relationships, motion conditions, and the like between components in a specific attitude (as shown in the figure), and if the specific attitude changes, the directional indication also changes accordingly.

In addition, if the embodiments of the present application relate to descriptions of "first", "second", and the like, the descriptions of "first", "second" and the like are set only for the purpose of description, and cannot be construed as indicating or implying the relative importance thereof or implicitly specifying the number of indicated technical features. Thus, features that define "first", "second" may explicitly or implicitly include at least one such feature. In addition, the technical solutions between the various embodiments may be combined with each other, but must be realized by persons skilled in the art. When the combination of the technical solutions contradicts each other or cannot be realized, it should be considered that the combination of the technical solutions does not exist, nor is it within the scope of protection claimed in the present application.

The present application provides a light fixture control system, which is arranged in an illumination system.

Figure 1:
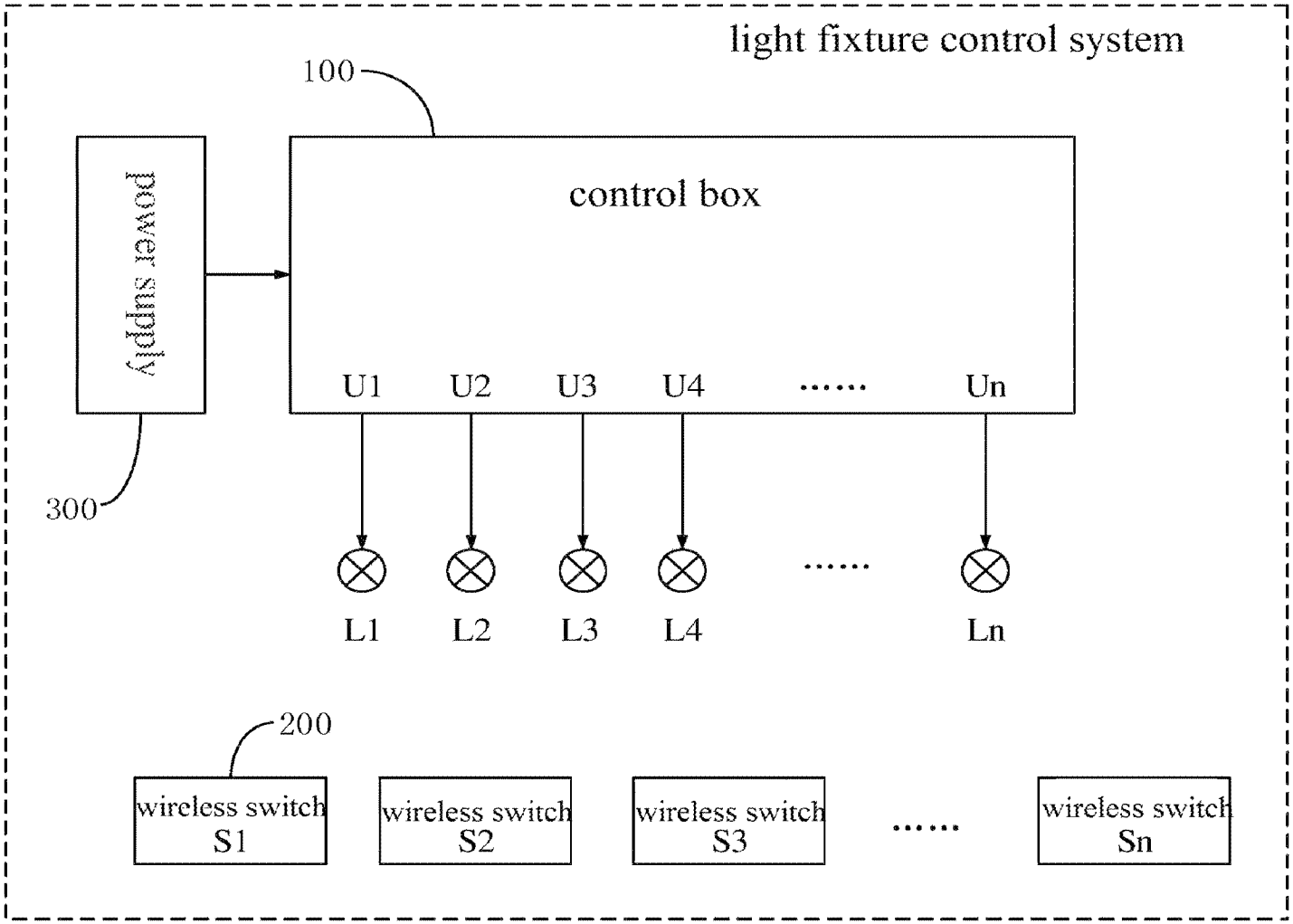
FIG. 1 is a functional block diagram of a light fixture control system of the present application.
Figure 2:
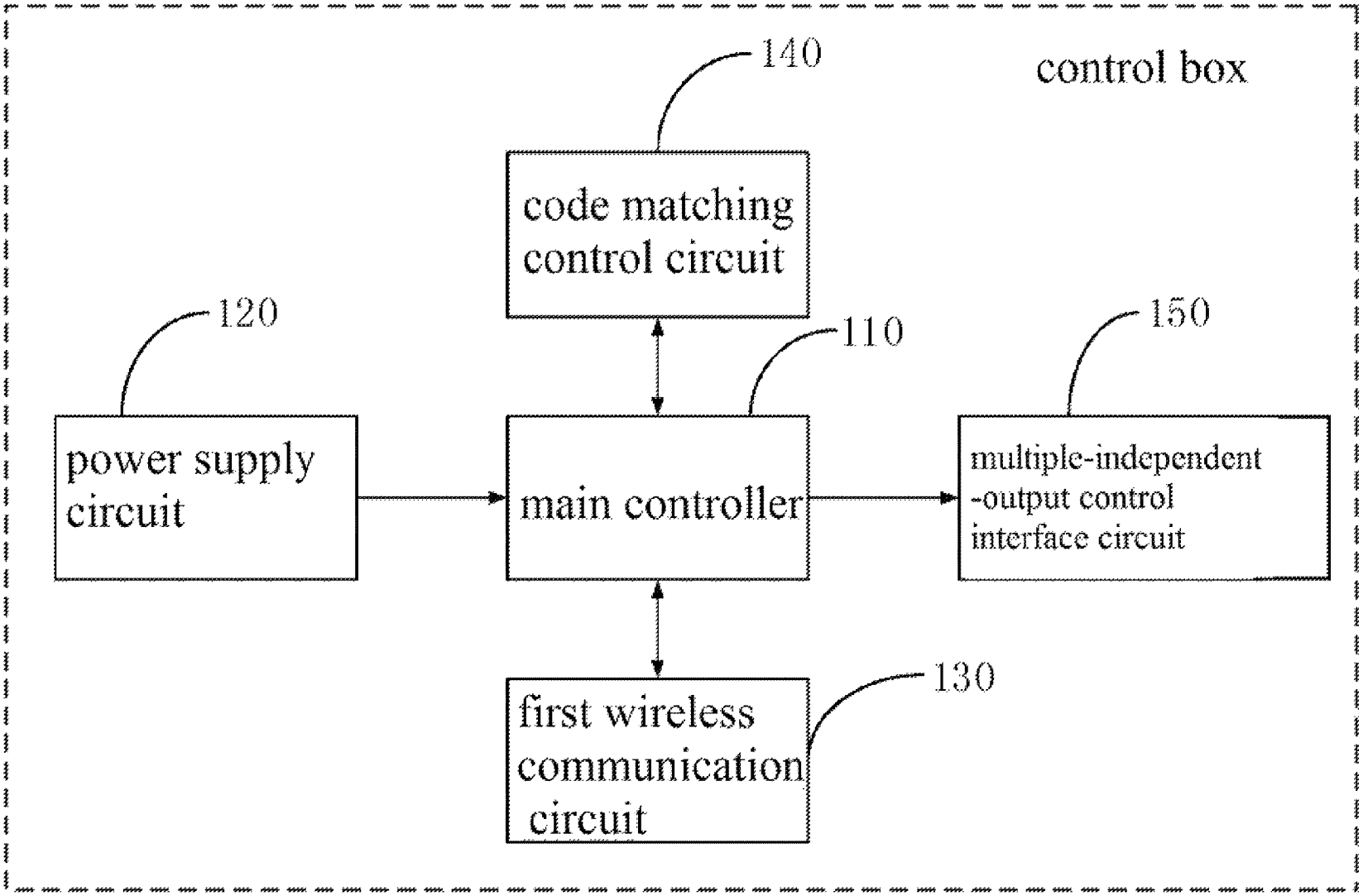
FIG. 2 is a functional block diagram of a control box in a light fixture control system of the present application.

Referring to FIGS. 1 and 2, in one embodiment of the present application, the light fixture control system includes a control box 100 and at least one wireless switch 200, and the wireless switch 200 is communicatively connected to the control box 100. The output end of the control box 100 is connected to an LED lamp. The control box 100 includes a main controller 110, a code matching control circuit 140, a first wireless communication circuit 130, and a multiple-independent-output control interface circuit 150. The main controller 110 is connected to the code matching control circuit 140 and the first wireless communication circuit 130, respectively. The output end of the main controller 110 is connected to the multiple-independent-output control interface circuit 150. The output ends of the multiple-independent-output control interface circuit 150 are connected to a plurality of LED lamps in a one-to-one correspondence. In particular:

The first wireless communication circuit 130 is configured to receive a wireless switch signal output by the wireless switch 200;

The code matching control circuit 140 is configured to output a corresponding code matching signal to the main controller 110 according to an operation instruction of a user;

The main controller 110 is configured to output a corresponding LED switch control signal to the multiple-independent-output control interface circuit 150 according to the code matching signal and the wireless switch signal, and is configured to drive a corresponding LED lamp to operate.

In this embodiment, the light fixture control system includes a plurality of LED lamps L1, L2, L3, L4, . . . , Ln, and a plurality of wireless switches S1, S2, S3, . . . , Sn, and the independent output control interface circuit 150 in the control box is provided with a plurality of output channels U1, U2, U3, . . . , Un. In a specific application, if it is desired to implement that a plurality of wireless switches S1, S2, S3, . . . , Sn each independently and correspondingly control LED lamps L1, L2, L3, L4, . . . , Ln, then when the control box is powered on, a channel U1 is selected to enter a code matching state, and after code matching of the wireless switch S1 succeeds, a channel U2 continues to be selected to enter a code matching state, so that code matching of the wireless switch S2 succeeds, and code matching is performed sequentially in the above manner until the wireless switch Sn completes code matching of the channel Un. In this case, the wireless switches S1 and L1, the wireless switches S2 and L2, . . . , the wireless switches Sn and Ln all form a corresponding control relationship, and the corresponding LED lamp is controlled by operating the corresponding wireless switch 200, and the other lamps are not affected. If a combined control is desired, for example, the wireless switch S1 controls the lamp L1, the wireless switch S2 controls the lamps L2 and L3, and the wireless switch S3 controls all the lamps, then when the control box 100 is powered on, the channel U1 is selected to enter a code matching state, and after code matching of the wireless switch S1 succeeds, the channels U2 and U3 continue to be selected to enter a code matching state, therefore code matching of the wireless switch S2 to the channels U2 and U3 is completed, and Finally, the wireless switch S3 is selected to perform code matching on all the channels U1, U2, U3 . . . Un. After the above operations are completed, the wireless switch S1 can independently control the lamp L1, the wireless switch S2 can control the lamps L2 and L3 at the same time, and the wireless switch S3 can control the LED lamps L1, L2, L3, L4, . . . , Ln connected to all channels of the control box.

The code matching of the light fixture can be realized by arranging corresponding keys on the control box 100 or matching a remote controller. For example, the multi-channel independent output control interface circuit 150 is provided with six output ports, which are connected to six LED lamps L1, L2, L3, L4, L5, L6. six keys A, B, C, D, E and F can be correspondingly arranged on the control box 100, and corresponding indicator lamps are arranged at the positions of the six keys. The six keys A, B, C, D, E and F correspond to code matching control of L1, L2, L3, L4, L5 and L6. Specifically, the key A is pressed, and the indicator lamp corresponding to the key A flashes (or in other indication manner) to indicate that the key A is selected. In this case, the wireless switch S1 is operated to perform code matching to control the first lamp, and when the key B is pressed, the indicating lamp corresponding to the key B flashes (or in other indication manner) to indicate that the key B is selected, in this case, the wireless switch S2 is operated to perform code matching to control the second lamp. Likewise, the keys C, D, E and F are sequentially pressed, so that code matching and corresponding control of the LED lamps L3, L4, L5 and L6 by the wireless switches S3, S4, S5 and S6 can be respectively realized. Alternatively, the keys A and B may be pressed, and then the wireless switch S1 is operated to achieve code matching of channels where the LED lamps L1 and L2 are located, so that the wireless switch S1 can achieve control over the LED lamps L1 and L2, when the keys A, B and C are pressed, then the wireless switch S2 can achieve control over the LED lamps L1, L2 and L3, and the like. Specific setting can be conducted in advance according to the requirements of a user. Of course, it is also possible to set a code matching button here, and control over the LED lamps by the corresponding wireless switch can be achieved according to the number of key pressing times, for example, the LED lamps L1 and L2 are selected by pressing the key twice, then the LED lamps L1 and L2 can be controlled by the wireless switch S1 after code matching is performed by the wireless switch S1, after the key is pressed six times, then the LED lamps L1, L2, L3, L4, L5 and L6 can be simultaneously controlled by the wireless switch S1 after code matching is performed by the wireless switch S1. In other embodiments, code matching and control of the LED lamp can also be achieved by providing a remote controller adapted to the control box 100 and providing corresponding keys on the remote controller, which will not be explained one by one herein.

In practical application, the control box can be arranged in small spaces such as a multi-door cabinet or a wardrobe, and can also be arranged on each layer of bookshelf of a desk. When a user needs to open one cabinet in the multi-door cabinets, the LED lamps corresponding to the cabinets can be controlled to be turned on through the control box. For example, when a first lamp of a first cabinet needs to be turned on, the first lamp can be independently controlled through code matching control of the control box 100. Alternatively, the control box should be arranged on a bookshelf, when a user searches for books on a certain layer of the bookshelf, the wireless sensing switch senses the action or approach of a human body, and the lamp is automatically turned on, making it more convenient for the user to perform browsing and searching. Compared with the conventional control box that can only collectively control the switches of all LED lamps, the control box 100 can control the LED lamps independently or in a combined manner, so that the LED lamps can be configured according to the requirements of a user, thereby improving the user experience, and also avoiding the need to turn on each LED when one cabinet in the multi-door cabinet is opened. Therefore, energy can be saved, and power consumption of the illumination system can be reduced.

It should be noted that, the power supply circuit 120 incorporates an AD-DC conversion circuit configured to convert the input power supply into an operating voltage of 3-5 V for operation of modules such as the main controller 110. The control box 100 in the present application can also realize online use between a plurality of control boxes. Specifically, for example, in an online light fixture control system implemented by three control boxes U1, U2, U3, U1 is mated to LED lamps L1, L2, L3, U2 is mated to LED lamps L4, L5, L6, U3 is mated to LED lamps L7, L8, and L9, and if one wireless switch is desired to control LED lamps L1, L2, L3, L4, L5, L6, L7, L8, and L9 at the same time, then only the wireless switch needs to form a code matching relation with the corresponding channels of all lamps connected in the control boxes U1, U2 and U3. Of course, through code matching with the corresponding channels in the control boxes, the other wireless switch may also be configured to simultaneously control the three lamps L1 in U1, L4 in U2, and L7 in U3, and the like. Specific setting can be conducted according to user requirements.

In this embodiment, the main controller 110 may be a single chip microcomputer, and in other embodiments, the main controller 110 may also be implemented by one of an MCU, a DSP, or an FPGA, which is not limited herein.

By arranging the code matching control circuit 140 in the present application, the control box 100 outputs a corresponding code matching signal to the main controller 110, after receiving a code matching instruction of the wireless switch 200. In this way, the main controller 110 outputs a plurality of code matching control instructions when receiving corresponding code matching signals. Therefore, code matching of multiple output channels of the multiple-independent-output control interface circuit 150 by each wireless switch 200 is realized, in turn, a single or combined control of the LED lamps is realized by the control box 100. The present application implements the function of independently controlling LED lamp groups or controlling LED lamp groups in a combined way, and solves the problem that a single control box 100 in a current light fixture control system does not have multiple independent output control interfaces, can only perform the control of LED lamps uniformly at the same time, cannot implement the combined control of LED lamps, cannot adapt to different lighting scenarios, resulting in poor applicability, high cost and high energy consumption.

Referring to FIGS. 1 and 2, in some embodiments, the light fixture control system further includes a power supply 300, an output end of the power supply 300 is connected to a power supply input end of the control box 100, and the power supply 300 is configured to supply power to the main control box and a plurality of LED lamps.

In a specific application, the power supply power supply 300 is configured to be externally connected to household lighting power, and an AC-DC conversion circuit may be disposed inside the power supply power supply power supply 300, and is configured to convert an alternating current of 100-240V, so as to provide a direct current operating voltage of 12V or 24V to the control box 100, and the power supply power supply 300 is connected to the light fixture to supply power to the light fixture.

Referring to FIGS. 1 and 2, in some embodiments, the plurality of wireless switches 200 includes one or more of a wireless gesture switch, a wireless PIR switch, a wireless touch switch, a wireless microwave switch, and a wireless mechanical key switch.

In this embodiment, the first wireless communication circuit 130 is configured to be communicatively connected to the wireless switch 200, and the wireless switch 200 may be one or more of a wireless gesture switch, a wireless PIR (Person Infrared Radiation) switch, a wireless touch switch, a wireless microwave switch, and a wireless mechanical key switch. For example, a wireless IR switch (one of the gesture switches) may be accessed by the control box 100 while the sensing distance of the handle is set to be within the range of 0-50 mm (or other suitable distance), i.e., when the IR switch is triggered by waving, shielding, moving away the hand within the range, the lamp is turned on or off or dimmed. By providing a wireless PIR switch, and setting the sensing distance of human body to 0-3000 mm (or other suitable distance), that is, when a person appears within a range of 0-3 m from the switch, the lamp is turned on, and so on. Examples will not be explained one by one herein. In other embodiments, a wireless touch switch, a wireless mechanical key switch, or the like also can be accessed. In practical application, these different types of switches may be placed in different places of a house separately from the control box, for example, the wireless IR switch may be placed at the bedside according to the requirement of a user, so that the user can conveniently operate the switch in a close range to remotely control the switch of the LED lamp.

It should be noted that the wireless switch 200 may also be other types of wireless switches known to persons skilled in the art, which is not limited herein.

It can be understood that different types of wireless switches 200 can be conveniently arranged at different places of the home according to the specific requirements of the user, and need not be connected to the input end of the control box by electric wires, and need not be routed in a wall or a cabinet, so that the installation is convenient, and the safety of the illumination system can be improved.

Figure 3:
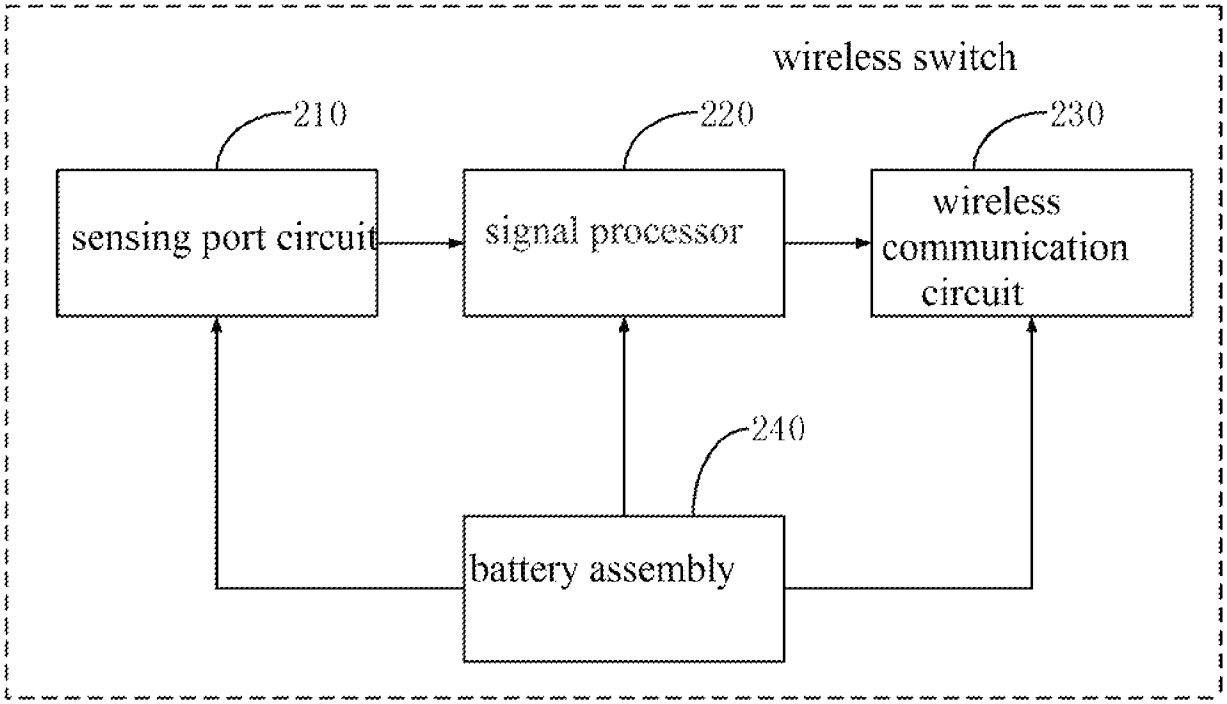
FIG. 3 is a functional block diagram of a wireless switch in a light fixture control system of the present application.
Figure 4:
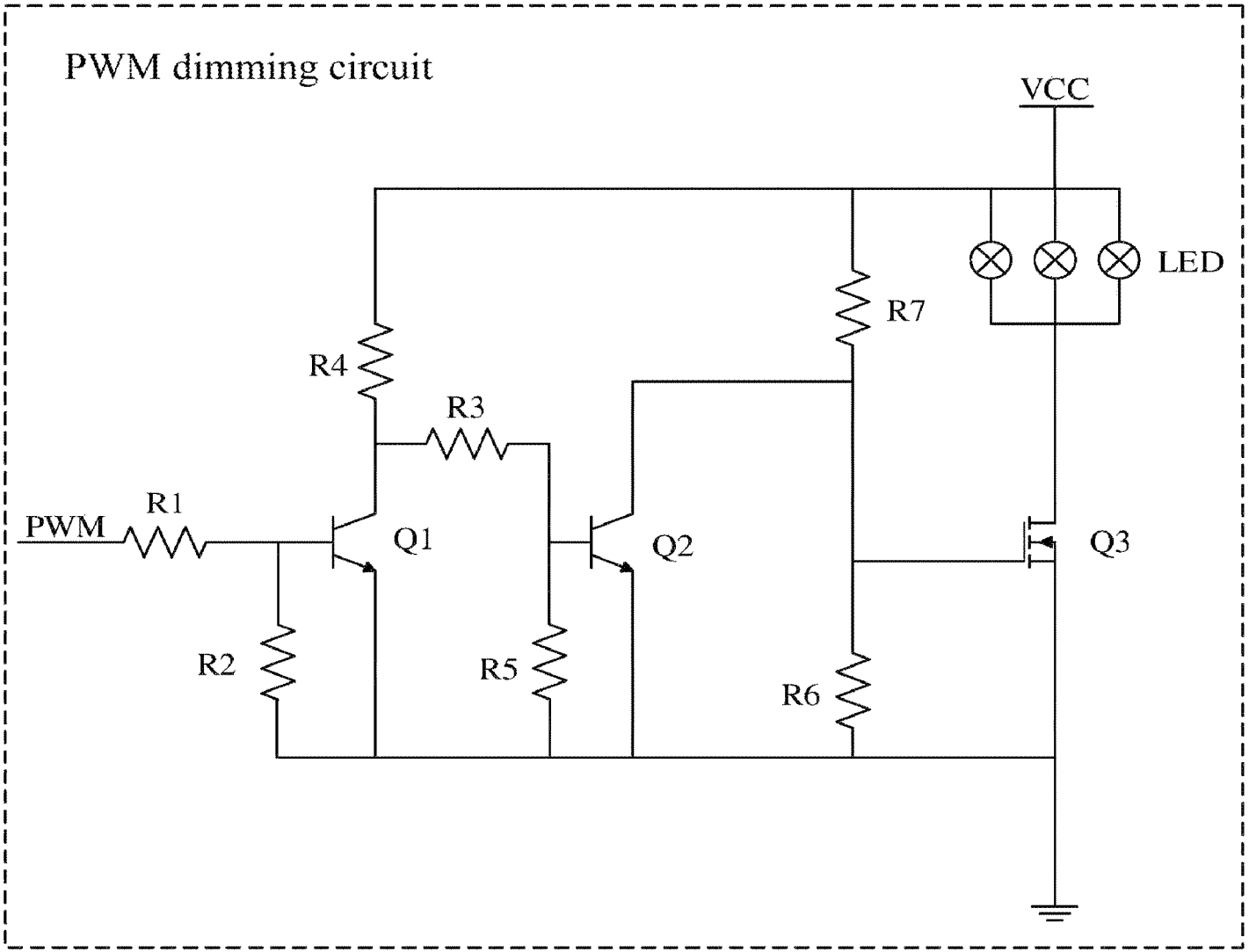
FIG. 4 is a schematic diagram of a circuit structure of a light fixture control system PWM dimming circuit of the present application.

Referring to FIGS. 2 and 3, in some embodiments, the wireless switch 200 includes a battery assembly 240, a sensing port circuit 210, a signal processor 220 and a second wireless communication circuit 230, an input end of the sensing port circuit 210 is configured to input a sensing signal, and an output end of the sensing port circuit 210 is connected to the signal processor 220. The output end of the signal processor 220 is connected to the second wireless communication circuit 230. An input/output end of the second wireless communication circuit 230 is an input/output end of the wireless switch 200. In particular:

The sensing port circuit 210 is triggered based on an operation instruction of a user and outputs a corresponding trigger signal to the signal processor;

The signal processor 220 is configured to generate a first control signal according to the received trigger signal and output the first control signal;

The second wireless communication circuit 230 is configured to output the received first control signal to the first wireless communication circuit 130.

In this embodiment, the sensing port circuit 210 is a receiving end that receives different operation instructions of the user, and realizes wireless connection and communication with the first wireless communication circuit 130 in the control box 100 through the wireless switch 200.

Further, the sensing port circuit 210 includes one or more of a touch assembly, a mechanical key assembly, an infrared emission detection assembly, a human body heat sensing detection assembly, and a microwave detection assembly.

Specifically, In this embodiment, a touch assembly is taken as an example for description, for example, the touch assembly includes a touch screen, and when the touch screen senses a motion of a human body, the sensing port circuit 210 outputs an operation instruction triggered by the human body to the signal processor 220, and the signal processor simultaneously performs processing such as A/D conversion and amplification on the signal and finally outputs the signal to the second wireless communication circuit 230.

In this embodiment, the battery assembly 240 is configured to provide an operating voltage to the wireless switch 200, and the battery assembly may be implemented by any one of a dry battery, a button battery, and a lithium battery, or, in other embodiments, a charging battery may also be used as the battery assembly 240. The signal processor 220 may be implemented by a microprocessor such as an MCU, a DSP, an FPGA, or a single chip microcomputer, which is not limited herein.

Referring to FIGS. 1 to 3, in some embodiments, the connection of the first wireless communication circuit 130 and the second wireless communication circuit 230 includes one or more of a 2.4G module, a Bluetooth module, an infrared module, a WIFI module, and a ZigBee module.

In this embodiment, the communication of the wireless switch 200 and the control box 100, that is, the connection of the first wireless communication circuit 130 and the second wireless communication circuit 230 may be one or more of a 2.4G connection, a Bluetooth connection, an infrared connection, a WIFI connection, a 433M connection, a 315M connection, or a ZigBee connection. The first wireless communication circuit 130 and the second wireless communication circuit 230 can be in wireless communication, so as to realize communication connection between the control box and the wireless switch and control corresponding LED to work. In other embodiments, the connection of the first wireless communication module 4 and the second wireless communication module 5 may also be a wireless connection technology known to persons skilled in the art, which is not described herein again.

Referring to FIGS. 1 to 4, in some embodiments, the main controller 110 is integrated with a PWM dimming circuit, an output end of the main controller 110 is connected to an input end of the PWM dimming circuit, and an output end of the PWM dimming circuit is configured to be connected to an LED lamp.

In this embodiment, the PWM dimming signal is output by the main controller and is then output to the LED lamp through the PWM dimming circuit, so that the main controller 110 realizes dimming of the LED lamp.

Further, the PWM dimming circuit includes a first resistor R1, a second resistor R2, a third resistor R3, a fourth resistor R4, a fifth resistor R5, a sixth resistor R6, a seventh resistor R7, a first electronic switch Q1, a second electronic switch Q2 and a third electronic switch Q3. The first end of the first resistor R1 is configured to input a PWM dimming signal, and the second end of the first resistor R1, a controlled end of the first electronic switch Q1, and a first end of the second resistor R2 are interconnected; a first connecting end of the first electronic switch Q1, a first end of the fourth resistor R4, and a first end of the third resistor R3 are interconnected, a second connecting end of the first electronic switch Q1, a second end of the second resistor R2, a second end of the fifth resistor R5, a second end of the sixth resistor R6, and a second connecting end of the third electronic switch Q3 are grounded; a second end of the third resistor R3, a first end of the fifth resistor R5, and a controlled end of the second electronic switch Q2 are interconnected; a first connecting end of the second electronic switch Q2, a second end of the seventh resistor R7, a first end of the sixth resistor R6, and a controlled end of the third electronic switch Q3 are interconnected; a second end of the fourth resistor R4, a first end of the seventh resistor R7, and a first end of the LED lamp are interconnected; the second end of the LED lamp is connected to the second connecting end of the third electronic switch Q3, the first end of the LED lamp is configured to connect the first direct current power supply VCC, and the first direct current power supply VCC may be a 12V or 24V direct current converted by the power supply 400.

In this embodiment, the PWM dimming circuit includes a controller outputting a PWM dimming signal, an input power supply of 12V/24V, a driving circuit composed of a first resistor R1, a second resistor R2, a third resistor R3, a fourth resistor R4, a fifth resistor R5, a first electronic switch Q1 and a second electronic switch Q2, and an LED lighting circuit composed of a sixth resistor, a seventh resistor, a third electronic switch Q3 and an LED lamp. The controller is a main controller 110, and in an initial state, the controller outputs a low level, and the first electronic switch Q1 and the second electronic switch Q2 are in an off state. In this case, the seventh resistor R7 receives a high-level driving signal to the controlled end of the third electronic switch Q3, so as to drive the third electronic switch Q3 to be turned on, and the LED lamp accesses the power supply VCC loop, and the LED lamp is turned on. The controller can adjust the light emission brightness of the LED lamp by controlling the duty ratio of the output PWM signal. When the first electronic switch Q1 and the second electronic switch Q2 receive the high-level signal output by the controller are turned on, a low-level driving signal is output to the controlled end of the third electronic switch Q3, so that the third electronic switch Q3 is driven to be turned off, and the LED lamp is turned off.

In this embodiment, the first electronic switch Q1 and the second electronic switch Q2 are NPN triodes, and the third electronic switch Q3 is an NMOS transistor. In other embodiments, the first electronic switch Q1, the second electronic switch Q2, and the third electronic switch Q3 may also be implemented by other types of switch transistors, which are not limited herein.

The present application further provides an illumination system, and the illumination system includes the light fixture control system as described above. For the detailed structure of the light fixture control system, reference may be made to the above embodiments, and details are not described herein again. It can be understood that, since the described light fixture control system is used in the illumination system of the present application, the embodiments of the illumination system of the present application include all the technical solutions of all the embodiments of the described light fixture control system, and the technical effects achieved are also identical and will not be described in detail herein.

The above description is only alternative embodiments of the present application and is not intended to limit the protection scope of the present application. Any equivalent structure variations used according to the contents of the specification and accompanying drawings in the present application, no matter whether it is directly or indirectly used in any other related technical field, should be included within the protection scope of the present application.

What is claimed is:

1. A light fixture control system, comprising a control box and at least one wireless switch, and the wireless switch is wirelessly and communicatively connected to the control box; an output end of the control box is connected to an LED lamp, the control box comprises a main controller, a code matching control circuit, a first wireless communication circuit and a multiple-independent-output control interface circuit, the main controller is connected to the code matching control circuit and the first wireless communication circuit, respectively and an output end of the main controller is connected to the multiple-independent-output control interface circuit; output ends of the multiple-independent-output control interface circuit are connected to a plurality of LED lamps in a one-to-one correspondence; wherein, the first wireless communication circuit is configured to receive a wireless switch signal output by the wireless switch;

the code matching control circuit is configured to output a corresponding code matching signal to the main controller according to an operation instruction of a user; and the main controller is configured to output a corresponding LED switch control signal to the multiple-independent-output control interface circuit according to the code matching signal and the wireless switch signal, and is configured to drive a corresponding LED lamp to operate.

2. The light fixture control system according to claim 1, wherein the light fixture control system further comprises a power supply, an output end of the power supply is connected to a power supply input end of the control box, and the power supply is configured to supply power to the control box and a plurality of LED lamps.

3. The light fixture control system according to claim 1, wherein the first wireless communication circuit comprises one or more of a 2.4G module, a Bluetooth module, an infrared module, a WIFI module, and a ZigBee module.

4. The light fixture control system according to claim 1, wherein the wireless switch comprises one or more of a wireless gesture switch, a wireless PIR switch, a wireless touch switch, a wireless microwave switch, a wireless mechanical key switch.

5. The light fixture control system according to claim 1, wherein the wireless switch comprises a battery assembly, a sensing port circuit, a signal processor and a second wireless communication circuit, and an output end of the battery assembly is connected to the sensing port circuit, the signal processor and the second wireless communication circuit, respectively; an input end of the sensing port circuit is configured to input a sensing signal, and an output end of the sensing port circuit is connected to the signal processor; an output end of the signal processor is connected to the second wireless communication circuit; an output end of the second wireless communication circuit is an output end of the wireless switch, wherein, the sensing port circuit is triggered based on an operation instruction of a user and outputs a corresponding trigger signal to the signal processor;

the signal processor is configured to generate a first control signal according to the received trigger signal and output the first control signal; and the second wireless communication circuit is configured to output the received first control signal to the first wireless communication circuit.

6. The light fixture control system according to claim 5, wherein the sensing port circuit comprises one or more of a touch assembly, a mechanical key assembly, an infrared emission detection assembly, a human body heat sensing detection assembly, and a microwave detection assembly.

7. The light fixture control system according to claim 5, wherein the second wireless communication circuit comprises one or more of a 2.4G module, a Bluetooth module, an infrared module, a WIFI module, and a ZigBee module.

8. The light fixture control system according to claim 1, wherein the main controller comprises a PWM dimming circuit, an output end of the main controller is connected to an input end of the PWM dimming circuit, and an output end of the PWM dimming circuit is configured to be connected to an LED lamp.

9. The light fixture control system according to claim 8, wherein the PWM dimming circuit comprises a first resistor, a second resistor, a third resistor, a fourth resistor, a fifth resistor, a sixth resistor, a seventh resistor, a first electronic switch, a second electronic switch, and a third electronic switch, a first end of the first resistor is configured to input a PWM dimming signal, a second end of the first resistor, a controlled end of the first electronic switch, and a first end of the second resistor are interconnected; a first connecting end of the first electronic switch, a first end of the fourth resistor, and a first end of the third resistor are interconnected, a second connecting end of the first electronic switch, a second end of the second resistor, a second end of the fifth resistor, a second end of the sixth resistor, and a second connecting end of the third electronic switch are grounded; a second end of the third resistor, a first end of the fifth resistor, and a controlled end of the second electronic switch are interconnected; a first connecting end of the second electronic switch, a second end of the seventh resistor, a first end of the sixth resistor, and a controlled end of the third electronic switch are interconnected; a second end of the fourth resistor, a first end of the seventh resistor, and a first end of the LED lamp are interconnected; a second end of the LED lamp is connected to a second connecting end of the third electronic switch, and a first end of the LED lamp is connected to a first direct current power supply.

10. An illumination system, comprising a plurality of LED lamps and a light fixture control system, wherein, the light fixture control system comprises a control box and at least one wireless switch, and the wireless switch is wirelessly and communicatively connected to the control box; an output end of the control box is connected to an LED lamp, the control box comprises a main controller, a code matching control circuit, a first wireless communication circuit and a multiple-independent-output control interface circuit, the main controller is connected to the code matching control circuit and the first wireless communication circuit, respectively and an output end of the main controller is connected to the multiple-independent-output control interface circuit; output ends of the multiple-independent-output control interface circuit are connected to a plurality of LED lamps in a one-to-one correspondence; wherein, the first wireless communication circuit is configured to receive a wireless switch signal output by the wireless switch;

the code matching control circuit is configured to output a corresponding code matching signal to the main controller according to an operation instruction of a user; and the main controller is configured to output a corresponding LED switch control signal to the multiple-independent-output control interface circuit according to the code matching signal and the wireless switch signal, and is configured to drive a corresponding LED lamp to operate.

11. The illumination system according to claim 10, wherein the light fixture control system further comprises a power supply, an output end of the power supply is connected to a power supply input end of the control box, and the power supply is configured to supply power to the control box and a plurality of LED lamps.

12. The illumination system according to claim 10, wherein the first wireless communication circuit comprises one or more of a 2.4G module, a Bluetooth module, an infrared module, a WIFI module, and a ZigBee module.

13. The illumination system according to claim 10, wherein the wireless switch comprises one or more of a wireless gesture switch, a wireless PIR switch, a wireless touch switch, a wireless microwave switch, a wireless mechanical key switch.

14. The illumination system according to claim 10, wherein the wireless switch comprises a battery assembly, a sensing port circuit, a signal processor and a second wireless communication circuit, and an output end of the battery assembly is connected to the sensing port circuit, the signal processor and the second wireless communication circuit, respectively; an input end of the sensing port circuit is configured to input a sensing signal, and an output end of the sensing port circuit is connected to the signal processor; an output end of the signal processor is connected to the second wireless communication circuit; an output end of the second wireless communication circuit is an output end of the wireless switch, wherein, the sensing port circuit is triggered based on an operation instruction of a user and outputs a corresponding trigger signal to the signal processor;

the signal processor is configured to generate a first control signal according to the received trigger signal and output the first control signal; and the second wireless communication circuit is configured to output the received first control signal to the first wireless communication circuit.

15. The illumination system according to claim 14, wherein the sensing port circuit comprises one or more of a touch assembly, a mechanical key assembly, an infrared emission detection assembly, a human body heat sensing detection assembly, and a microwave detection assembly.

16. The illumination system according to claim 14, wherein the second wireless communication circuit comprises one or more of a 2.4G module, a Bluetooth module, an infrared module, a WIFI module, and a ZigBee module.

17. The illumination system according to claim 10, wherein the main controller comprises a PWM dimming circuit, an output end of the main controller is connected to an input end of the PWM dimming circuit, and an output end of the PWM dimming circuit is configured to be connected to an LED lamp.

18. The illumination system according to claim 17, wherein the PWM dimming circuit comprises a first resistor, a second resistor, a third resistor, a fourth resistor, a fifth resistor, a sixth resistor, a seventh resistor, a first electronic switch, a second electronic switch, and a third electronic switch, a first end of the first resistor is configured to input a PWM dimming signal, a second end of the first resistor, a controlled end of the first electronic switch, and a first end of the second resistor are interconnected; a first connecting end of the first electronic switch, a first end of the fourth resistor, and a first end of the third resistor are interconnected, a second connecting end of the first electronic switch, a second end of the second resistor, a second end of the fifth resistor, a second end of the sixth resistor, and a second connecting end of the third electronic switch are grounded; a second end of the third resistor, a first end of the fifth resistor, and a controlled end of the second electronic switch are interconnected; a first connecting end of the second electronic switch, a second end of the seventh resistor, a first end of the sixth resistor, and a controlled end of the third electronic switch are interconnected; a second end of the fourth resistor, a first end of the seventh resistor, and a first end of the LED lamp are interconnected; a second end of the LED lamp is connected to a second connecting end of the third electronic switch, and a first end of the LED lamp is connected to a first direct current power supply.

* * * * *